United States Patent [19]

Dare-Edwards

[11] Patent Number: 4,786,427

[45] Date of Patent: Nov. 22, 1988

[54] ESTER COMPOUND LUBRICANTS

[75] Inventor: Martin P. Dare-Edwards, Parkgate, United Kingdom

[73] Assignee: Shell Oil Company, Houston, Tex.

[21] Appl. No.: 111,479

[22] Filed: Oct. 22, 1987

[30] Foreign Application Priority Data

Nov. 6, 1986 [GB] United Kingdom ..... 8626510

[51] Int. Cl.[4] ..... C10M 129/72

[52] U.S. Cl. ..... 252/56 R; 252/56 S; 252/56 D; 252/57; 560/193; 560/220

[58] Field of Search ..... 252/56 R, 56 S, 56 D, 252/57; 560/193, 220

[56] References Cited

U.S. PATENT DOCUMENTS

| | | | |
|---|---|---|---|
| 2,817,673 | 12/1957 | Roelen et al. | 252/57 |
| 2,824,065 | 2/1958 | Jolly | 252/57 |
| 2,849,399 | 8/1958 | Matuszak et al. | 252/57 |
| 3,296,065 | 1/1967 | O'Brien et al. | 162/158 |
| 3,835,050 | 9/1974 | Green | 252/28 |
| 4,178,261 | 12/1979 | Dhein et al. | 252/57 |

FOREIGN PATENT DOCUMENTS

| | | |
|---|---|---|
| 62-177098 | 8/1987 | Japan . |
| 62-177099 | 8/1987 | Japan . |
| 1593113 | 7/1981 | United Kingdom . |

*Primary Examiner*—Jacqueline V. Howard

[57] ABSTRACT

Use as lubricants, especially for tractive drives, of ester compounds of the general formula I

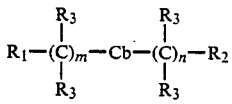

wherein Cb denotes a carboxylic grouping which may be monocarboxylic (MCb) of formula —O—CO—or —CO—O—, dicarboxylic (DiCb) of formula —O—CO—$R_4$—CO—O—or —CO—O—$R_4$—O—CO—, or tetracarboxylic (TCb) of formula —O—CO—$R_5$—CO—O—$R_6$—O—CO—$R_5$—CO—O—; $R_4$ represents an optionally substituted alkylene or alkenylene group, a $C_{5-10}$ cycloalkylene group, a di-($C_{5-10}$ cycloalkylene) group, or a $C_{5-10}$ cycloalkenylene group; $R_5$ represents an alkylene group and $R_6$ represents a cycloalkylene group;

each group $R_3$ individually represents a $C_{1-6}$ alkyl, $C_{2-6}$ alkenyl, $C_{3-20}$ mono- or polycycloalkyl group or a hydrogen atom; m and n are each 0 or 1;

$R_1$ represents an optionally substituted $C_{4-10}$ tertiary alkyl group or an optionally substituted $C_{3-8}$ cycloalkyl or $C_{6-14}$ bicyclo or tricycloalkyl group; and $R_2$ represents the same as $R_1$ or alternatively represents an optionally substituted alkyl, alkenyl, mono- or polycycloalkyl, mono or polycycloalkenyl group;

provided that when m and n are each O and Cb is MCb or DCb wherein $R_4$ is cyclohexylene, then $R_1$ and $R_2$ are not both cyclohexyl.

9 Claims, No Drawings

ESTER COMPOUND LUBRICANTS

The present process relates to the use of certain ester compounds as lubricants, in particular their use in tractive drives.

These lubricants can be used in a variety of engineering applications, being of particular value in tractive drives. Traction is broadly defined as the adhesive friction of a body on a surface on which it moves. A tractive drive is a device in which torque is transmitted from an input element to an output element through nominal point or line contact typically with a rolling action by virtue of the traction between the contacting elements. While tractive elements are commonly spoken of as being in contact, it is generally accepted that a fluid film is present therebetween. Almost all tractive drives require fluids to remove heat, to prevent wear at the contact surfaces and to lubricate bearings and other moving parts associated with the drive. Thus, instead of metal to metal rolling contact there is a film of fluid introduced into the contact zone and interposed between the metal elements. The nature of this fluid determines to a large extent the limits in performance and the capacity of the drive. Most tractive drives are designed to operate with a tractive fluid which preferably has a coefficient of traction above about 0.06, a viscosity in the range of about 4–20,000 mPas over a temperature range of 40° C. to −20° C. and good thermal and oxidative stability. The fluid should also be noncorrosive to common materials of construction and have good load-bearing and low wear-rate properties.

Mineral base oils are rather unsatisfactory lubricants for tractive drives since in general their traction (friction) coefficient is low, which means that for any given load applied to the gears the maximal tangential force that may be transmitted by the friction wheels is low.

It has now been found that certain ester compounds constitute excellent lubricants and traction fluids. Accordingly, the present invention provides the use as lubricants, and especially as traction fluids, of ester compounds of the general formula I

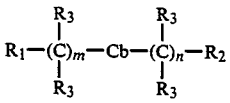

(I)

wherein Cb denotes a carboxylic grouping which may be monocarboxylic (MCb) of formula —O—CO— or —CO—O—, dicarboxylic (DiCb) of formula —O—CO—$R_4$—CO—0— or —CO—O—$R_4$—O—CO—, or tetracarboxylic (TCb) of formula —O—CO—$R_5$—CO—O—$R_6$—O—CO—$R_5$—CO—O—; $R_4$ represents an optionally substituted alkylene or alkenylene group, a $C_{5-10}$ cycloalkylene group, a di($C_{5-10}$ cycloalkylene) group, or a $C_{5-10}$ cycloalkenylene group; $R_5$ represents a alkylene, preferably ethylene, group and $R_6$ represents a cycloalkylene, especially cyclohexylene, group; each group $R_3$ individually represents a $C_{1-6}$ alkyl, $C_{2-6}$ alkenyl, $C_{3-20}$ mono- or polycycloalkyl group or, preferably, a hydrogen atom; m and n are each 0 or 1; $R^1$ represents an optionally substituted $C_{4-10}$ tertiary alkyl group, preferably tertiary butyl, or an optionally substituted $C_{3-8}$ cycloalkyl or $C_{6-14}$ bicyclo or tricycloalkyl group; and $R_2$ represents the same as $R_1$, or alternatively represents an optionally substituted alkyl, alkeny, mono- or polycycloalkyl, mono or polycycloalkenyl group; provided that when m and n are each O and Cb denotes either MCb or DCb wherein $R_4$ is cyclohexylene, then $R_1$ and $R_2$ are not both cyclohexyl.

The terms bicycloalkyl and polycycloalkyl group denote any group which contains two or more cycloalkyl groups. A polycycloalkenyl group is like a polycycloalkyl group but has at least one unsaturated carbon-carbon bond. This includes groups having fused rings, for example decahydronaphthyl (decalyl), bicyclo[2.2.-2]octyl and adamantyl groups. Another suitable fused ring system is a camphyl or bornyl group. When $R_1$ and/or $R_2$ represents a (bi)-cycloalkyl group, this is preferably a cyclohexyl, cyclopentyl or decalyl group.

$R_1$ and $R_2$ may contain substituents. Suitable substituents include alkyl, alkenyl, alkynyl, cycloalkyl, cycloalkenyl, polycycloalkyl, polycycloalkenyl, hydroxy, oxo, alkoxy, acyl, alkoxycarbonyl, cycloalkylalkoxycarbonyl, cycloalkoxycarbonyl, polycycloalkoxycarbonyl, alkylcarbonyloxy, cycloalkylcarbonyloxy, cycloalkylalkylcarbonyloxy, polycycloalkylcarboxyloxy and polycycloalkylalkylcarbonyloxy groups. When cycloalkyl groups are present as substituents, the cycloalkyl moieties may contain one or more $C_{1-6}$ alkyl groups, in particular methyl groups. The above mentioned alkyl, alkenyl, alkynyl and alkoxy substituents have preferably from 1 to 10, more preferably from 1 to 6 carbon atoms. The cycloalkyl substituents are preferably cyclohexyl or cyclopentyl groups. The polycycloalkyl group is preferably a decalyl group or a cyclohexyl group carrying a cycloalkyl group. The acyl groups include $C_{1-6}$ alkylcarbonyl groups.

The groups $R_3$ preferably represent relatively simple moieties, such as methyl groups or hydrogen atoms, thereby providing more accessible—and therefore cheaper—products. Higher traction coefficients, and thence better performance as traction fluids, are usually found whem m and n are both 0.

When Cb denotes MCb, and $R_1$ represents a tertiary alkyl group or a (bi)-cycloalkyl group, $R_2$ is advantageously selected from an optionally substituted $C_{1-20}$ alkyl, $C_{2-20}$ alkenyl and a decalyl group. Preferred such compounds are those wherein $R_1$ is cyclohexyl and $R_2$ is $C_{1-4}$ alkyl or $C_{17}$ alkyl substituted with a cyclohexyl carbonyloxy group, or both $R_1$ and $R_2$ represent cyclopentyl.

Good tractive properties are obtained with compounds having more than one ester group in their molecular formula, i.e. compounds wherein Cb denotes DiCb or TCb. Particularly useful dicarboxylic compounds are those of the general formula II:

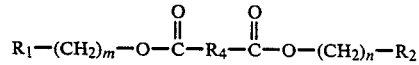

II wherein m and n are both 0 or 1; $R_1$ and $R_2$ are the same and each represents a cyclopentyl or cyclohexyl group optionally bearing $C_{1-4}$ alkyl substituents, a decalyl group or a tertiary butyl group, and $R_4$ is as defined above, preferably being chosen so that at most 3 carbon atoms separate the carboxyl groups. Especially preferred compounds are those of formula II wherein both $R_1$ and $R_2$ represent cyclohexyl groups, and $R_4$ is a cyclohexylene, a methylene, ethylene, vinylene or trimethylene group, which group may contain one or more $C_{1-10}$ alkyl substituents and/or $C_{1-20}$ alkyl or alkenyl moieties substituted by a cyclohexyloxycarbonyl, cyclohexylmethoxycarbonyl, neopentoxy carbonyl or a methoxycarbonyl group.

Preferred individual compounds are biscyclohexyl malonate, succinate or glutarate, in which the cyclohexyl moieties or the malonate, succinate or glutarate groups may contain one or more methyl substituents, since these compounds have very high traction coefficients.

It has been found that the viscosity characteristics of the above ester compounds are very suitable for use in e.g. friction wheel gears (tractive drives) in which application they may be admixed with conventional grease thickeners. Such thickeners can be of any number of materials commonly used to thicken mineral oils to lubricating viscosity, including both organic and inorganic compositions such as metallic soaps, synthetic polymers, organosiloxanes, clays, bentonite, and colloidal silica. Suitably, the viscosity properties of compounds to be used in tractive drives are such that the compounds are operable between −30° and 150° C. To achieve this it is advantageous that the ester compounds in the lubricants according to the invention have a viscosity of at most 1000, preferably 250 $mm^2/s$ at 40° C. and at least 1, preferably 3 $mm^2/s$ at 100° C.

The compounds can be used as lubricants in various engineering applications. Since the above ester compounds show excellent lubricating performance in tractive drives the invention in particular provides the use of these ester compounds as traction fluids, and also to operation of a tractive drive wherein such esters form the tractive fluid.

The ester compounds of the present invention can be used per se as lubricants. They can be mixed with other lubricants such as mineral or synthetic oils, and various additives can be added to the ester compounds, such as VI-improvers, pour point depressants, dispersants, detergents, anti-oxidants and the like.

Some of the ester compounds used in the present invention are novel compounds. Accordingly, the present invention further provides ester compounds of formula I as defined above, subject to the proviso that when m and n are both O and Cb represents DiCb, then $R_4$ is not $—CH_2—$, $—CH(CH_3)—$, $—CH_2CH_2—$ or $—CH_2CH(CH_3)—$.

All preferences expressed for the ester compounds in relation with their use as lubricants also apply to the novel ester compounds per se.

These ester compounds are preferably prepared by heating a compound of formula

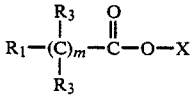

with an alcohol of formula

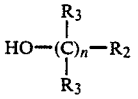

in which X is H or methyl, and n, m, $R_1$, $R_2$ and $R_3$ are as defined above. The reaction is conveniently carried out in the presence of a strong acid, e.g. p-toluenesulphonic acid, sulphuric acid or hydrochloric acid. The temperature is preferably elevated, e.g. from 50° to 200° C., more preferably it is the reflux temperature. The water formed by the esterification (or methanol formed when X is methyl) can be removed azeotropically when the (trans)esterification is carried out in an entraining agent, which forms an azeotrope with water or methanol. Suitable entraining agents include hydrocarbon liquids, in particular benzene, toluene, xylene and mixtures thereof.

When one of the substituents is a cyclohexyl ring, the compound can be obtained from the corresponding phenyl-containing compound by hydrogenation. The hydrogenation can be carried out using various catalysts, such as nickel, platinum, rhodium or palladium. Preferably the catalytic material is applied onto a support such as carbon, silica, alumina, silica-alumina and the like. Hydrogen is fed to the phenyl-containing compound at pressures of 1–15 bar, at temperatures from 50°–250° C. The phenyl-containing compound can be, but need not be, incorporated in a solvent. Suitable solvents include formic and acetic acid.

The invention will now be illustrated by means of the following Examples, in which some compounds are characterised by their Refractive Index determined at wavelength 546.1 nm, denoted as RI.

EXAMPLES

The following compounds have been prepared.

(a) of general formula

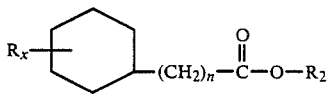

| Compound No. | n | $R_x$ | $R_2$ | Boiling point (°C./mmHg) |
|---|---|---|---|---|
| 1 | 0 | — | methyl | 183/758 |
| 2 | 1 | — | methyl | 201/750 |
| 3 | 0 | — | ethyl | 194–196/759 |
| 4 | 0 | 2-methyl | ethyl | 203–204/753 |
| 5 | 1 | — | ethyl | 95–97/11 |
| 6 | 0 | — | cyclohexyl | 105–110/1.5 |
| 7 | 1 | — | cyclohexylmethyl | 122–126/1.0 |

(b) of general formula

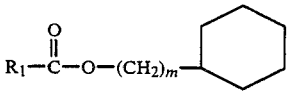

| Compound No. | m | $R_1$ | Boiling point (°C./mmHg) |
|---|---|---|---|
| 8 | 0 | methyl | 172–173/760 |
| 9 | 0 | ethyl | RI 1.4408 |
| 10 | 0 | n-butyl | RI 1.4435 |
| 11 | 0 | i-butyl | RI 1.4415 |
| 12 | 0 | 1-(11-cyclohexyl-carbonyloxy)heptadecyl | 232–234/0.1 |

(c) of general formula

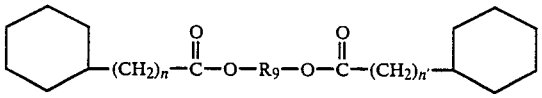

| Compound No. | n | n[1] | $R_9$ | Boiling point (°C./mmHg) |
|---|---|---|---|---|
| 13 | 0 | 0 | ethylene | 159–162/1.6–2.0 |
| 14 | 0 | 0 | 1-octyl-2-(7-methoxy-carbonylheptyl) ethylene | 206–208/0.1 |

(d) of general formula

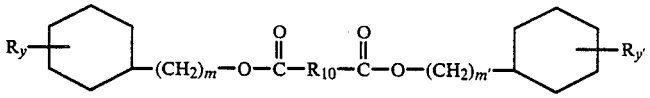

| Compound No. | m | m[1] | $R_{10}$ | $R_y$ | $R_{y'}$ | Boiling point (°C./mmHg) or RI |
|---|---|---|---|---|---|---|
| 15 | 0 | 0 | methylene | — | — | 164/2.5 |
| 16 | 0 | 0 | dimethylmethylene | — | — | RI 1.4659 |
| 17 | 0 | 0 | ethylene | — | — | 152–156/0.9 |
| 18 | 0 | 0 | methylethylene | — | — | RI 1.4716 |
| 19 | 0 | 0 | 1,1-dimethylethylene | — | — | RI 1.4704 |
| 20 | 0 | 0 | ethylene | 2-methyl | 2-methyl | 168–176/1.6–2.4 |
| 21 | 0 | 0 | ethylene | 4-methyl | 4-methyl | 172–176/1.5–2.0 |
| 22 | 0 | 0 | trimethylene | — | — | 177–186/2.2–3.8 |
| 23 | 0 | 0 | 1[1-(cyclohexyloxycarbonyl)heptadec-10-yl-ethylene | — | — | >240/0.2 |
| 24 | 1 | 1 | 1-[1-(cyclohexylmethoxycarbonyl)heptadec-10-yl]ethylene | — | — | 286–310/0.2–0.3 |
| 25 | 1 | 1 | 1-[1-(cyclohexylmethoxycarbonyl)heptadec-8-en-10-yl]vinylene | — | — | 29.2–29.4/0.2 |
| 26 | 0 | 0 | 1,2-cyclohexylene | — | — | RI 1.4909 |
| 27 | 0 | 0 | 1,2-cyclohexylene | methyl | methyl | RI 1.4849 |
| 28 | 0 | 0 | 1,3-(1,2,2-trimethyl)cyclopentylene | 5-methyl-2-prop-2-yl | 5-methyl-2-prop-2-yl | RI 1.4765 |
| 34 | 0 | 0 | $CH_2CH_2$ | 5-methyl-2-prop-2-yl | 5-methyl-2-prop-2-yl | RI 1.4712 m.pt.c. 35° C. |
| 35 | 0 | 0 | bis(cyclohex)-4,4'ylene | — | — | m.pt. 69° C. |
| 36 | 0 | 0 | decal-1,5-ylene | — | — | m.pt. 48° C. |

(e) of general formula

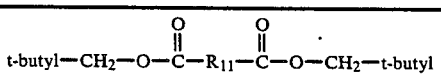

| Compound No. | $R_{11}$ | Boiling point (°C./mmHg) |
|---|---|---|
| 29 | ethylene | 128–134/5–7 |
| 30 | 1-[1(neopentoxycarbonyl)-heptadec-8-en-10-yl]vinylene | 238–255/0.15 |

(f) of general formula

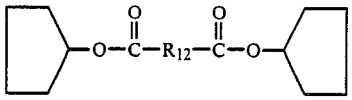

| Compound No. | $R_{12}$ | RI |
|---|---|---|
| 31 | 1-[1-(cyclopentylmethyloxycarbonyl)-heptadec-8-en-10-yl]vinylene | RI 1.4771 |

(g) of general formula

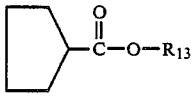

| Compound No. | $R_{13}$ | Boiling point (°C./mmHg) |
|---|---|---|
| 32 | cyclopentyl | 70–72/0.8–1.0 |

(h) of formula

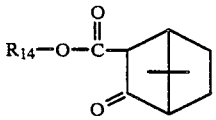

| Compound No. | $R_{14}$ | RI |
|---|---|---|
| 33 | 2-isopropyl-5-methylcyclohexyl | 1.4879 |

Compound No. 37

-continued

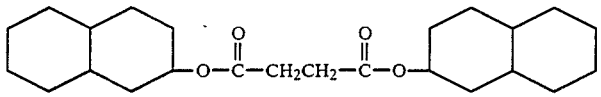

Compounds of formula

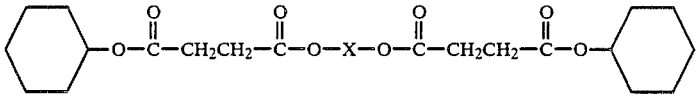

| Compound No. | X | Physical Prop. |
|---|---|---|
| 38 | 1,2-cyclohexylene | RI 1.4851 |
| 39 | 1,3-cyclohexylene | RI 1.4858 |
| 40 | 1,4-cyclohexylene | m.pt. 60° C. |

Methods of preparation

Compounds 1–11 were prepared via standard methods:

the acid was taken up in the appropriate alcohol, optionally in the presence of a small quantity of an acid, e.g. p-toluenesulphonic acid, and subsequently the mixture was refluxed for a while and the ester separated from the alcohol by means of distillation.

Compound 12 was prepared as follows:

Cyclohexanol (50 ml) was refluxed in toluene (200 ml) with 12-hydroxy stearic acid and 4-toluenesulphonic acid (1 g) and water was removed azeotropically until no more water was collected. The solution was washed with sodium bicarbonate and water and the product, isolated by removing the solvent in a rotary evaporator, was cyclohexyl 12-hydroxystearate.

Cyclohexyl 12-hydroxystearate (100 g) was dissolved in toluene (250 ml) and pyridine (21 g). The solution was stirred and heated to 50° C. Cyclohexylcarboxylic acid chloride (38.5 g) was added dropwise causing the temperature of the mixture to rise to 70° C. At the end of the addition the reaction mixture was maintained at 80° C. for 2 hours. After cooling, it was washed with sodium bicarbonate and then with water until neutral. Solvents were removed in a rotary evaporator and the residue distilled. The product, cyclohexyl 12-cyclohexylcarbonyloxystearate, was collected at 232°–234° C./0.1 mm Hg.

Compound 13 was prepared as follows:

Ethylene glycol (436 g, 7.0 mole) and cyclohexane carboxylic acid (1.83 kg, 14.3 mole) were refluxed together in toluene (1 L) in the presence of p-toluene sulphonic acid (18.0 g). The water formed was collected in a Dean and Stark trap and the reaction was continued until no more water was produced (14 hours). The solution was then cooled and washed firstly with a saturated sodium bicarbonate solution and then by a saturated sodium chloride solution.

The reaction gave dicyclohexylcarbonyloxyethane (1.92 kg, 87.7% w/w, 85.0% yield) as a pale brown oil.

The crude product was distilled under reduced pressure and the reactions boiling at 159°–162° C. and 1.6–2.0 mm Hg were combined to give dicyclohexylcarbonyloxyethane (1.5 L, 97.3% w/w by glc analysis) as a pale yellow oil.

Compound 14 was prepared as follows:

9,10-Dihydroxystearic acid (253 g), m.p. 91°–92° C., was refluxed for 10 hours in methanol (1500 ml) containing 4-toluenesulphonic acid (1.3 g). Concentrated sulphuric acid (5 g) was added after 5 hours. The reaction mixture was filtered and solvent removed in a rotary evaporator. The product was dissolved in dichloromethane and the solution washed with sodium bicarbonate solution to remove residual acidity. After removal of this solvent the product was recrystallized from petroleum spirit (b.p. 60–80), washed with petroleum spirit after isolation by filtration and air dried. The yield was 210 g. Melting point 70°–71° C.

A solution of methyl 9,10-dihydroxystearate (55.5 g) in toluene (200 ml) and pyridine (28 g) was heated to 50° C. Cyclohexylcarboxylic acid chloride (50 g) was added dropwise to the stirred solution causing the formation of a white precipitate. At the end of the addition the reaction mixture was heated to 80° C. and stirred at this temperature for 2 hours. After cooling, it was washed with sodium bicarbonate solution and then with water until neutral. It was dried over magnesium sulphate and solvent removed. The residue was distilled under reduced pressure and the product collected at 255°–258° C./0.08 mm Hg.

Compounds 15–22 were prepared as follows:

The acids were refluxed with the appropriate alcohol in a toluene mixture and in the presence of p-toluene sulphonic acid. The molar ratio acid:alcohol was 1:2. The preparation and work-up procedure were as described for compound 13.

Compound 25 was prepared as follows:

Methyl oleate (0.5 mole) and maleic anhydride (1.0 mole) were stirred together at reflux under nitrogen. Samples were removed hourly and examined by GLC. After 8 to 10 hours this examination showed that over 90% of the reactants varied between 180° and 230° C. After cooling, the product was dissolved in ether and washed with water (20×50 ml) until the pH of the washings rose from 1 to 4. The ether solution was dried over anhydrous sodium sulphate before removal of solvent to give the product as a dark brown, viscous liquid.

This methyl oleate/maleic anhydride addition product was dissolved in three times its own volume of methanol and refluxed for 6 to 8 hours in the presence of concentrated sulphuric acid (1%v). Methanol was removed in a rotary evaporator and replaced by ether. The ethereal solution was washed with water, 5% sodium carbonate solution and water until the washings were neutral. After drying the solution, the solvent was removed in a rotary evaporator and the residue distilled.

The required trimethyl ester was collected as a pale yellow oil with a boiling point of 232°-236° C./0.8-1.0 mm Hg.

The product from esterification with methanol of the methyl oleate/maleic anhydride adduct was dissolved in toluene (5×volume) and refluxed with the cyclohexanol alcohol (50% molar excess) in the presence of 4-toluenesulphonic acid (1%w on ester). A mixture of methanol, toluene and unreacted alcohol was removed continuously during the reaction but the reaction mixture was topped up at intervals with more toluene and the required alcohol. The product was worked up as described for compound 13. To isolate the product the raw product was eluted over silica gel using petroleum ether (30°-40° C.) as eluent. The eluent was removed in a rotary evaporator to yield compound 25. Compound 23 was obtained from compound 22 by hydrogenation as described in J. Org. Chem., 1966, 31, 3989 (G. A. Brown and H. C. Brown). At the end of the reaction the reaction mixture was filtered to remove catalyst and then ethanol was removed in a rotary evaporator. The residue was dissolved in dichloromethane, washed with water and sodium carbonate solution and then water until neutral. Solvent was removed from the dry solution in a rotary evaporator to yield compound 23. Compound 24 was prepared in analogy to compound 23, using cyclohexylmethanol instead of cyclohexanol. Compound 26 was prepared by dissolving dicyclohexylphthalate (1.0 kg, 3.03 mole) with warming, in glacial acetic acid (2.0 L). The solution was hydrogenated over 5% rhodium on carbon (50 g) at 90° C. and 6 atmospheres of hydrogen pressure. After 48 hours the reaction had stopped and so the catalyst was filtered. The solution was then hydrogenated over fresh 5% rhodium on carbon (25 g) for a further 6 hours until the hydrogenation was complete. The catalyst was filtered and the solution was evaporated up to a temperature of 60° C. at high vacuum. The resulting oil was dissolved in dichloromethane (1 L) and washed successively with a saturated sodium bicarbonate solution (1 L) and water (1 L). The dried ($Na_2SO_4$) organic solution was evaporated up to a temperature of 75° C. at high vacuum to give dicyclohexyl-1,2-cyclohexane carboxylate (914.4 g, 99.3% w/w, 98.2% yield) as a colourless oil. Compound 27 was prepared in analogy of compound 23 starting from bis-(methylcyclotrexyl)-phthalate. Compound 28 was prepared by esterification of 1,2,2-trimethylenecyclopentane-1,3-dicarboxylic acid with 5-methyl-2-prop-2-yl cyclohexanol in analogy to the preparation of compounds 15-22. Compounds 29 and 30 were prepared in a similar manner as compounds 17 and 25, respectively, using neopentanol instead of cyclohexanol. Compound 31 was prepared as compound 25 using cyclopentanemethanol. Compound 32 was prepared as compounds 1-11 using cyclopentanol as alcohol. Compound 33 was prepared by using 5-methyl-2-prop-2-yl cyclohexanol and camphor-3-carboxylic acid in an analogous process to the preparation of compound 1.

FRICTION COEFFICIENT MEASUREMENT

All friction measurements were performed on a two-disc machine. Hardened steel discs are fixed on the ends of two shafts so as to make tangential contact with each other. Radial forces may be applied to press the discs together with loads of 0-200 kgf. Each disc is driven by an electric motor. The speeds of rotation of the two discs are different, such that there is a slip.

Between the electric motor and the shaft carrying the lower test specimen, a measuring device is fitted which indicates the transmitted friction torque. The measuring device is a gear dynamometer with a pendulum which is swung out of its vertical balanced position when power is transmitted, the sine of the angle of inclination being a measure of the torque. The torque measurement is pre-calibrated through the design and dimensions of the instrument. The friction coefficient is defined by the torque measured divided by the product of the radial force times the radius of the lower disc.

Both discs used had a diameter of 50.0 mm, the upper disc having a width of 3 mm, the lower one having a width of 10 mm. The top shaft speed was 606 rpm, and the mean tangential (or surface) velocity was 1.48 $ms^{-1}$. The slip employed was 9.1%.

All experiments were run at ambient temperature (21° C.±2° C.). The friction readings are provided at 50 kgf, 100 kgf, 150 kgf and 200 kgf loadings, equivalent to Hertzian stresses of 0.69, 0.97, 1.19 and 1.38 GPa respectively.

The friction coefficients of the compounds are indicated in the following Table.

The kinematic viscosity properties of the compounds are also included in this Table.

TABLE

| Compound No. | Friction coefficients 50 kgf | 100 kgf | 150 kgf | 200 kgf | $V_k$ 40° C. (mm/s) | $V_k$ 100° C. (mm/s) |
|---|---|---|---|---|---|---|
| 1 | 0.066 | 0.062 | 0.061 | 0.062 | 1.32 | 0.67 |
| 2 | 0.056 | 0.057 | 0.060 | 0.063 | — | — |
| 3 | 0.064 | 0.060 | 0.061 | 0.062 | — | — |
| 4 | 0.064 | 0.062 | 0.065 | 0.066 | — | — |
| 5 | 0.061 | 0.059 | 0.060 | 0.063 | — | — |
| 6 | 0.061 | 0.077 | 0.082 | 0.086 | 7.16 | 2.06 |
| 7 | 0.062 | 0.073 | 0.078 | 0.082 | 7.89 | 2.3 |
| 8 | 0.060 | 0.063 | 0.065 | 0.069 | — | — |
| 9 | 0.037 | 0.047 | 0.054 | 0.060 | — | — |
| 10 | 0.029 | 0.042 | 0.053 | 0.060 | — | — |
| 11 | 0.054 | 0.062 | 0.066 | 0.070 | — | — |
| 12 | 0.042 | 0.053 | 0.060 | 0.065 | 54.5 | 8.48 |
| 13 | 0.062 | 0.081 | 0.089 | 0.093 | 12.6 | 3.03 |
| 14 | 0.043 | 0.053 | 0.059 | 0.063 | 100.6 | 10.7 |
| 15 | 0.091 | 0.108 | 0.108 | 0.113 | 17.6 | 3.36 |
| 16 | 0.099 | 0.110 | 0.113 | 0.111 | 14.8 | 3.05 |
| 17 | 0.098 | 0.109 | 0.112 | 0.111 | 23.8 | 3.92 |
| 18 | 0.093 | 0.107 | 0.110 | 0.110 | 22.1 | 3.75 |
| 19 | 0.106 | 0.114 | 0.116 | 0.116 | 27.0 | 4.06 |
| 20 | 0.096 | 0.104 | 0.107 | 0.106 | 21.8 | 3.75 |
| 21 | 0.087 | 0.096 | 0.100 | 0.099 | 26.1 | 4.16 |
| 22 | 0.073 | 0.092 | 0.098 | 0.102 | 20.0 | 3.92 |
| 23 | 0.058 | 0.068 | 0.072 | 0.076 | 169.5 | 14.34 |
| 24 | 0.042 | 0.055 | 0.062 | 0.066 | 122.6 | 12.5 |
| 25 | 0.051 | 0.060 | 0.066 | 0.069 | 170.7 | 14.98 |
| 26 | 0.102 | 0.111 | 0.117 | 0.120 | 271.2 | 10.13 |
| 27 | 0.098 | 0.106 | 0.110 | 0.111 | 255.6 | 9.46 |
| 28* | 0.097 | 0.109 | 0.113 | 0.113 | 33.7 | 4.69 |
| 29 | 0.063 | 0.074 | 0.079 | 0.081 | 5.48 | 1.66 |
| 30 | 0.057 | 0.063 | 0.066 | 0.070 | 120.3 | 10.95 |
| 31 | 0.036 | 0.048 | 0.054 | 0.058 | 73.4 | 10.16 |
| 32 | 0.045 | 0.048 | 0.051 | 0.053 | 2.36 | 1.11 |
| 33 | 0.087 | 0.091 | 0.095 | 0.100 | 737.0 | 11.49 |
| 34 | | solid at 21° C. | | | 130.67 | 6.39 |
| 35 | | solid to 69° C. | | | — | |
| 36 | | solid at 21° C. | | | 791.3 | 46.65 |
| 37 | 0.085 | 0.095 | 0.101 | 0.104 | 663.3 | 18.57 |
| 38 | 0.078 | 0.091 | 0.096 | 0.104 | 773.3 | 18.9 |
| 39 | 0.077 | 0.086 | 0.091 | 0.095 | 919.7 | 22.36 |
| 40 | | solid to 60° C. | | | — | 30.08 |

*as a 20% m/m blend with compound 17.

From these results it is apparent that especially compounds 15-22 and 26-28 have very high friction coefficients and transmit power excellently.

We claim:

1. Use as lubricants of esters of general formula II

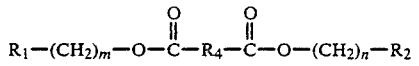

(II)

wherein m and n are each 0 or 1, $R_4$ is an alkylene or alkenylene group unsubstituted or substituted by one or more alkyl groups containing from 1 to 4 carbon atoms, such that at most 3 carbon atoms separate the carboxyl groups; and $R_1$ and $R_2$ are the same and each represents a cyclopentyl or cyclohexyl group unsubstituted or substituted by $C_{1-4}$ alkyl groups.

2. Use according to claim 1 wherein $R_1$ or $R_2$ both represent cyclohexyl groups and $R_4$ is a methylene, ethylene, vinylene or trimethylene group unsubstituted or substituted by one or more alkyl groups containing from 1 to 4 carbon atoms.

3. Use according to claim 1 wherein m and n both represent 0.

4. Use according to claim 1 wherein the ester is biscyclohexyl malonate, succinate or glutarate unsubstituted or by substituted one or more methyl substituents.

5. Use according to claim 1 in which the ester compound has a kinematic viscosity of at most 1000 $mm^2/s$ at 40° C. and at least 1 $mm^2/s$ at 100° C.

6. Lubricant composition which contains as the major component an ester as defined in claim 1.

7. Use as a traction fluid of an ester as defined in claim 1.

8. Methd of operating a tractive drive wherein the tractive fluid is an ester as defined in claim 1.

9. An ester of formula

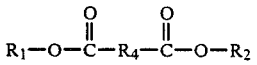

wherein $R_1$ and $R_2$ both are cyclohexyl groups and $R_4$ is a vinylene or trimethylene group unsubstituted or substituted by one or more alkyl groups containing from 1 to 4 carbon atoms.

* * * * *